US008205416B2

(12) United States Patent
Hansen

(10) Patent No.: US 8,205,416 B2
(45) Date of Patent: Jun. 26, 2012

(54) METHOD AND DEVICE FOR PRODUCING AND FILLING CONTAINERS

(76) Inventor: Bernd Hansen, Sulzbach-Laufen (DE)

( * ) Notice: Subject to any disclaimer, the term of this patent is extended or adjusted under 35 U.S.C. 154(b) by 1239 days.

(21) Appl. No.: 10/582,869

(22) PCT Filed: Dec. 27, 2004

(86) PCT No.: PCT/EP2004/014724
§ 371 (c)(1),
(2), (4) Date: Jun. 14, 2006

(87) PCT Pub. No.: WO2005/073087
PCT Pub. Date: Aug. 11, 2005

(65) Prior Publication Data

US 2008/0041019 A1 Feb. 21, 2008

(30) Foreign Application Priority Data

Jan. 30, 2004 (DE) ..... 10 2004 004 755

(51) Int. Cl.
*B65B 3/04* (2006.01)

(52) U.S. Cl. ..... 53/452; 53/433; 53/561; 53/558; 264/524

(58) Field of Classification Search ..... 53/476–478, 53/485, 433, 425, 426, 561, 452, 558; 264/524; 425/524
See application file for complete search history.

(56) References Cited

U.S. PATENT DOCUMENTS

| | | | | |
|---|---|---|---|---|
| 4,244,914 | A * | 1/1981 | Ranalli et al. | 264/515 |
| 4,510,115 | A * | 4/1985 | Gokcen et al. | 264/515 |
| 5,152,968 | A * | 10/1992 | Foti et al. | 422/304 |
| 5,792,435 | A * | 8/1998 | Mueller et al. | 422/292 |
| 5,872,359 | A * | 2/1999 | Stewart et al. | 250/339.12 |
| 5,879,648 | A * | 3/1999 | Hada et al. | 422/304 |
| 6,098,676 | A | 8/2000 | Poynter et al. | |
| 2002/0159915 | A1 * | 10/2002 | Zelina et al. | 422/3 |
| 2004/0065983 | A1 * | 4/2004 | Hansen et al. | 264/524 |
| 2006/0249887 | A1 * | 11/2006 | Maddox | 264/524 |

FOREIGN PATENT DOCUMENTS

| | | |
|---|---|---|
| AT | 3 88 149 | 5/1989 |
| DE | 21 34 166 | 1/1973 |
| DE | 40 39 040 | 6/1992 |
| DE | 196 48 087 | 5/1997 |
| DE | 100 63 282 A1 | 7/2002 |
| DE | 100 63 282 C2 | 7/2002 |
| JP | 60 049919 | 3/1985 |
| WO | WO 02/49821 | 6/2002 |

* cited by examiner

*Primary Examiner* — Thanh Truong
(74) *Attorney, Agent, or Firm* — Roylance, Abrams, Berdo & Goodman L.L.P.

(57) ABSTRACT

A method ignites the combustion of fuel in a combustion chamber (5) of engine (2), by introducing microwave radiation into the combustion chamber (5). The microwave radiation is produced in a microwave source (7) on the outside of the combustion chamber (5). The introduced microwave radiation is absorbed by the fuel distributed in the combustion chamber (5). The supply of energy, in the fuel, arising from absorption, distributes combustion in a large-volume in the combustion chamber (5), preferably in the entire combustion chamber (5) and in a homogenous manner, and is essentially simultaneously ignited. An associated ignition device (1) and an associated engine (2) are also provided.

15 Claims, 2 Drawing Sheets

METHOD AND DEVICE FOR PRODUCING AND FILLING CONTAINERS

FIELD OF THE INVENTION

The present invention relates to a method for producing and filling containers in which at least one tube made of a softened plastic material is extruded into an open mold. The tube is heat sealed at its projecting end when the mold is closed to form the bottom of the container. The tube is separated above the mold by a separating element to form a fill hole. The mold, along with the tube having the open fill hole, is moved into a filling position in which the container is filled and then sealed after being configured in the mold by generating a pressure gradient that acts upon the tube and expands the same. The fill hole of the tube is covered by a sterile barrier at least from the time the fill hole is formed to the time the container is filled in a sterile space. The present invention also relates to a device for application of such method.

BACKGROUND OF THE INVENTION

A production method and production device have been disclosed in the relevant state of the art under the trade name Bottelpack®. The production method permits cost-effective automated molding (blowing and vacuum molding), filling, and sealing of containers. If the containers are to be filled with high-sensitivity products, such as pharmaceuticals for which international standards for aseptic packaging are to be met, the mold, when moved to the filling position, is closed in an area called the sterile filling space in which sterile air is blown over the uncovered fill opening of containers and provides effective protection from penetration by germs. Movable head jaws of the mold are closed until after completion of the filling process to effect the desired sealing of the end of the container by a combined vacuum and welding process. Such sterile filling areas and their devices for sterile filling of containers are of the state of the art and are disclosed, for example, in DE 196 48 087 A1 or U.S. Pat. No. 6,098,686.

While the fill opening is effectively protected by the sterile filling space in the filling position, the fill opening when open is not fully protected during movement of the mold from the extrusion position, in which the tube which has been formed is separated below the extruder nozzle and the fill opening is formed, until the filling position has been reached, even if the process is conducted in a clean space. In other words, the tube having the fill opening forms an open receptacle on the upper side during movement of the mold into the filling position. To increase the certainty of sterility, a process and a device are disclosed in DE 100 63 282 A1 (corresponding to U.S. Pat. No. 7,357,893) as state of the art, which take care to make certain that the fill opening of the tube is covered by a sterile barrier during movement of the mold into the filling position. The known sterile barrier is in the form of a heatable plate which may be moved together with the element separating the tube. The plate is heated to a germ-killing temperature, preferably one above 120° C. In the process, the sterile barrier is in such a position and provided with such dimensions that it is situated, when the separating element is in the operating position, above the path of movement leading to the filling position of the mold and covering the fill opening, until it has reached the sterile filling space.

Not only does this known solution prevent the danger of falling of alien bodies into the uncovered fill opening after separation of the tube before the mold has reached the sterile filling space, but the sterile barrier also prevents access of germs to the fill opening during this part of the process, so that the desired freedom from germs has been achieved to a very great extent.

SUMMARY OF THE INVENTION

An object of the present invention is to provide a method and device for molding, filling and sealing containers with improved freedom from germs in the area of the filler opening of a container, to provide the possibility of introducing high-sensitivity products for the medical/pharmaceutical area of application into the containers.

This object is basically attained by a method and a device according to the present invention in which, by a sterile barrier, at least one sterile medium is moved by a medium conveying device in the direction of the filler opening of the tube, immediately after separation of the tube by the separating element (cutter blade). The sterility (high freedom from germs) is ensured in that the sterile medium sweeps at least over the fill opening and thus forces germs of any nature away from the fill opening or does not even allow such access in the direction of the fill opening.

The sterile media to be moved by the medium delivery device to the filler opening, can be sterile air and/or nitrogen and/or other media such as inert gases, hydrogen peroxide, etc. The medium delivery device may move the respective sterile medium in the direction of the fill opening under a specified excess pressure and/or, with the support of an exhaust device as part of the medium delivery device, may move excess sterile medium, but preferably non-viable particles, to the exterior from the site of the fill opening from the molding device. Sterile media such as steam or hydrogen peroxide are employed to sterilize the sterile barrier and the supply lines of the media delivery device. Sterilization of the barrier preferably is effected in advance of beginning of operation, but may be carried out at discrete time intervals during interruptions of production. Sterile medium, preferably in the form of an inert gas, may also be used for charging the container, for example, if the content of the product is oxygen-sensitive.

In another advantageous configuration of the method and the device of the present invention, the sterile barrier is in the form of a plate-shaped cover element moving back and forth with the separating element for separation of the plastic tubes or moves simultaneously with parts of the production mold.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1A:
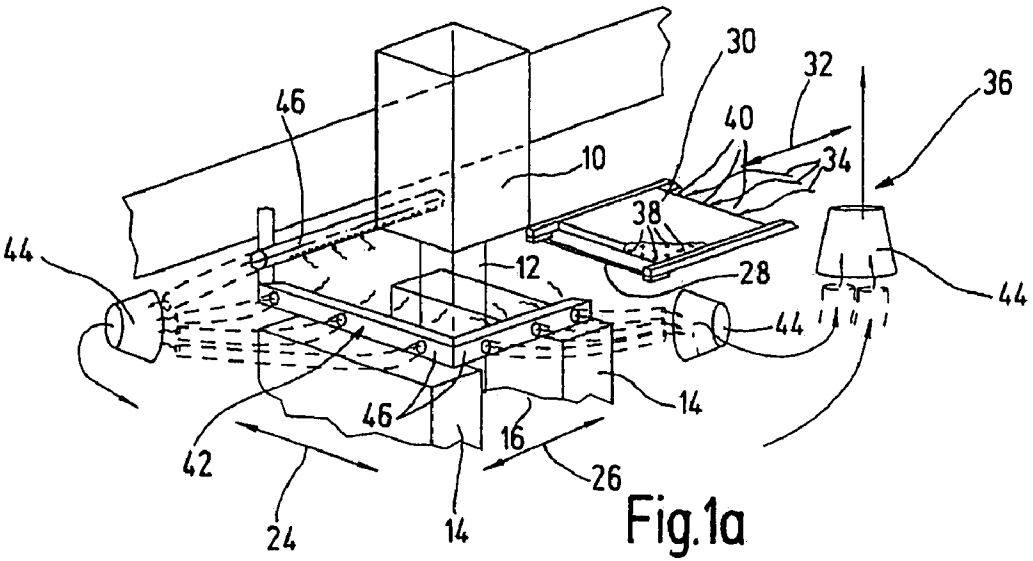
FIGS. 1*a*, 1*b* and 1*c* are diagrammatic, not to scale, perspective views of the essential parts of a production device according to a first exemplary embodiment of the present invention.
Figure 1C:
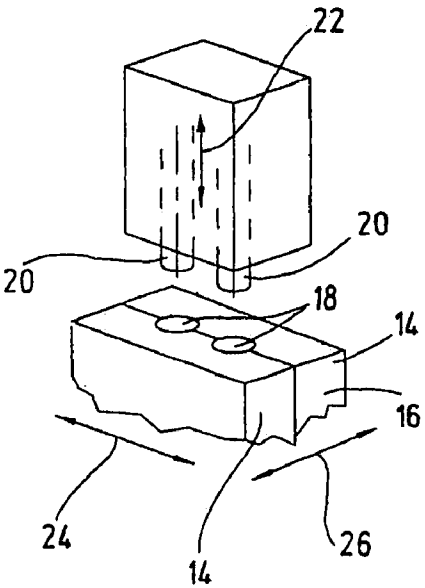
Figure 1B:
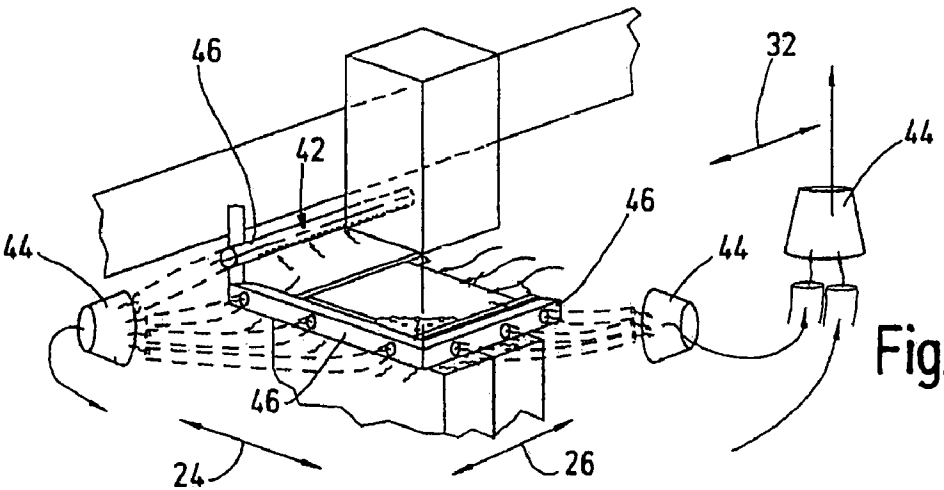

FIGS. 1*a-c* and 2*a-c* show parts of devices for production of plastic containers in the blow molding process. A tube 12 of melted plastic material is extruded by an extruding means or extruder 10 between the two mold halves 14 of a mold 16. Mold 16 is shown in the opened position in FIG. 1*a* and in the closed position in FIGS. 1*b* and 1*c*. After extrusion of the tube 12 into the opened mold 16, the tube 12 is separated by cutter 28 between the mouth of the nozzle of the extruding device 10 and the upper side of the mold 16. FIGS. 1*b*, 1*c* show the mold 16 in the closed position, the parts making up the majority of the parts of the container to be formed from the tube 12. The mold halves 14 are brought together so that the bottom-side welding edges on the lower end of the tube 12 effect a welding process to seal the tube 12 along a welding seam (not shown).

FIG. 1*c* shows the mold 16 in a filling position in which the mold has been displaced sideways from the position shown in FIGS. 1*a,b* oriented toward the extruder means 10. In this filling position, the container (not shown) which was previously formed by blowing of blast air through the open fill or filler opening 18 is filled with the desired filling material via the fill opening 18. FIG. 1*c* illustrates the end of the charging mandrel 20 to be introduced into the respective fill opening 18 for this purpose. The vertical reciprocating movement of the charging mandrels 20 is indicated in FIG. 1*c* by a double arrow 22. The lateral back-and-forth movement of the mold 16 is indicated by a double arrow 24. The potential opening and closing movement of the two jaws 14 of the mold 16 is indicated by a double arrow 26. Molding and charging of the container may also be effected by a combined blowing-charging mandrel in place of the charging mandrels 20 and a previously introduced blowing mandrel (not shown). The mold 16 shown is not restricted to production of one or two containers. On the contrary, a plurality of containers positioned side by side in a row is customarily produced. The process of producing only a single container is explained for the sake of greater simplicity of presentation.

In the filling position shown in FIG. 1*c*, the mold is positioned below an area called the sterile filling space (not shown in the figures), which effects aseptic shielding of the fill opening 18 formed by the preceding process of separation of the tube 12. After the container has been charged, the filling mandrel is moved away upward and the still open movable upper welding or head jaws (not shown) of the mold 16 are brought together to effect shaping of container neck and/or simultaneously to seal this neck by welding. The respective production steps are customary up to this point and are elements of the Bottelpack® system referred to in the foregoing.

FIG. 1*a* shows the status of operation before separation of the respective tube 12. A heatable blade serves as separating element 28 mounted at a specified distance or also at zero distance on the front side of a plate-shaped cover element 30 serving as a sterile barrier. The separating element 28 and cover element 30 are moved back and forth in the directions indicated by the double arrow 32, from a base position as shown in FIG. 1*a* to an operating position as shown in FIG. 1*b* and vice versa.

By the sterile barrier in the form of a plate-shaped cover element 30, a sterile medium 34 may be transported in the direction of the fill opening 18 by media delivery device 36. Sterile air and/or nitrogen and/or other media such as other inert gases, hydrogen peroxide, etc. qualify as sterile media 34 moved to the filler opening 18 by the media delivery device 36. For the purpose of transporting the sterile medium 34, the plate-shaped cover element 30 has, in the direction of the fill opening 18, medium discharge points or ports 38 as part of the media delivery device. Points 38 are configured as perforations in the plate 30, and permit delivery of the medium by entry points or ports 40 in the direction of the filler opening. The sterile medium 34 is blown in the direction of the filler opening 18. The entry points or ports 40, which are also a component of the media delivery device, are present in the rear area of the cover element 30, on the side opposite the narrow front side of the cover element 30 with the separating element or blade 28. Conveyance of the sterile medium 34, especially in the form of sterile air, to the cover plate 30 and through the media exit points 38 in the direction of the fill opening 18 is effected by excess or overpressure, i.e., a pressure greater than ambient air pressure.

To sterilize the barrier in advance of production proper with the device, provision has been made for conduction of steam or other suitable means such as hydrogen peroxide through the barrier with its openings, in addition to the delivery lines. The sterile medium may then be conducted by the sterile barrier to the fill openings for commencement of production proper. If an inert gas such as nitrogen is employed as sterile medium for use of the sterile barrier, this gas may also be used to keep the container filled with the inert gas. This selection is a logical step if the specific product with which the container is to be filled is oxygen-sensitive.

Protection is provided for the fill opening 18 itself when, as shown in FIG. 1*b*, the tube 12 has been separated by the separating element 28. The cover element 30 has been moved to the front position, and covers the point of separation of the two mold halves 14 at least in the area of the fill opening. Consequently, when the media delivery device 36 has been actuated, the sterile medium is blown by excess pressure in the direction of the longitudinal axis of the container toward and into the filler opening. If appropriate removal points are provided in the cover element 30, the possibility also exists of washing the interior of the container and accordingly the filler opening 18 by blowing the sterile medium 34 in and immediately exhausting it over other parts of the media delivery device 36. However, delivery of sterile medium may be made completely independent of the exhaust output of the respective parts of the media delivery device 36.

The media delivery device 36 may have an exhaust device 42, preferably one in the form of a vacuum device. By a specified negative pressure, exhaust device 42 carries the respective sterile medium 34 away from the filler opening 18 by central evacuation points 44. The evacuation device, as part of the media delivery device 36, is used chiefly for the purpose of evacuating the non-viable particles generated during separation of the tube. In the process, overflowing sterile medium may be evacuated with the non-viable particles and be removed from the device. By preference, equilibrium exists between the amount of medium flowing out of the perforation as a result of excess pressure and the amount of medium evacuated from the evacuation device 42.

The possibility of removal by the central evacuation points 44 is correspondingly indicated in the figures by arrows. In addition, the exhaust or vacuum device 42 surrounds the plate-shaped cover element 30 as a frame in the form of frame components 46 positioned relative each other to form a rectangle, but allowing entry into and departure of the sterile barrier in the form of the cover element 30.

To achieve an especially good germicidal effect, the sterile medium is conducted at a temperature meeting the sterility requirements. For example, the medium 34 is at a temperature above 120° C., preferably at a temperature in the range of 150° C. to 200° C. In addition or as an alternative, the sterile barrier or the cover element 30, preferably is made of stainless steel materials, may be heated to that temperature range. If the evacuation device 42 has sufficient output potential, the medium 34 need not be delivered by a pumping or blowing device. In some instances, the exhaust output is sufficient to ensure conduction of the medium and accordingly flow through the respective filler opening 18.

If, as is illustrated in FIG. 1*b*, the tube section is separated by the separating element 28 to form the filler opening, the closed mold 16 comes to the charging station as shown in FIG. 1*c*. Sterile safety is ensured by the sterile filling space (ASR), as has already been pointed out. After the mold has been returned to the initial position as shown in FIG. 1*a*, a tube section may then be extruded into the shaping components of the mold halves 14 to form the container.

Figure 2C:
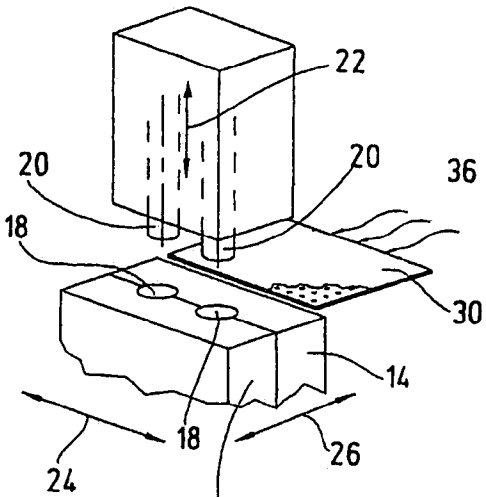
FIGS. 2*a*, 2*b* and 2*c* are diagrammatic, not scale, perspective views of the essential parts of a production device according to a second exemplary embodiment of the present invention.
Figure 2A:
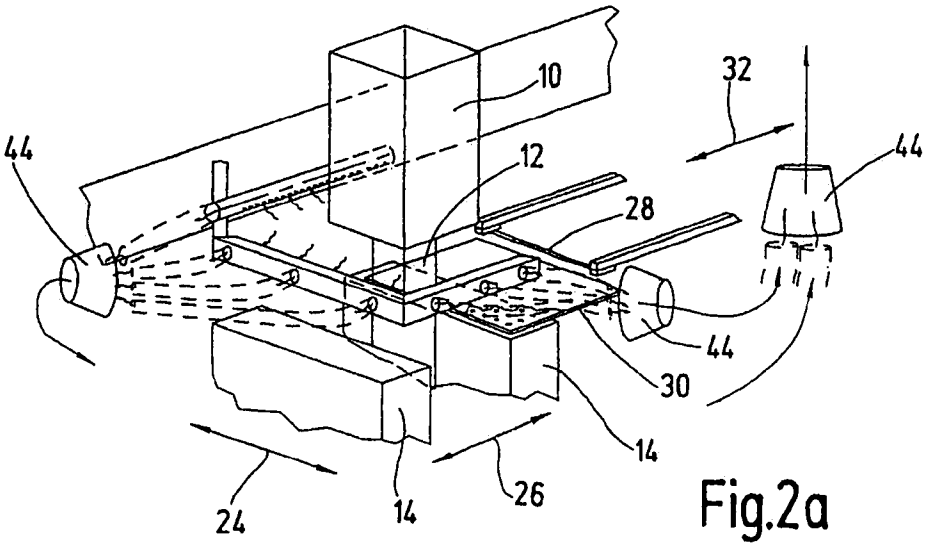
Figure 2B:
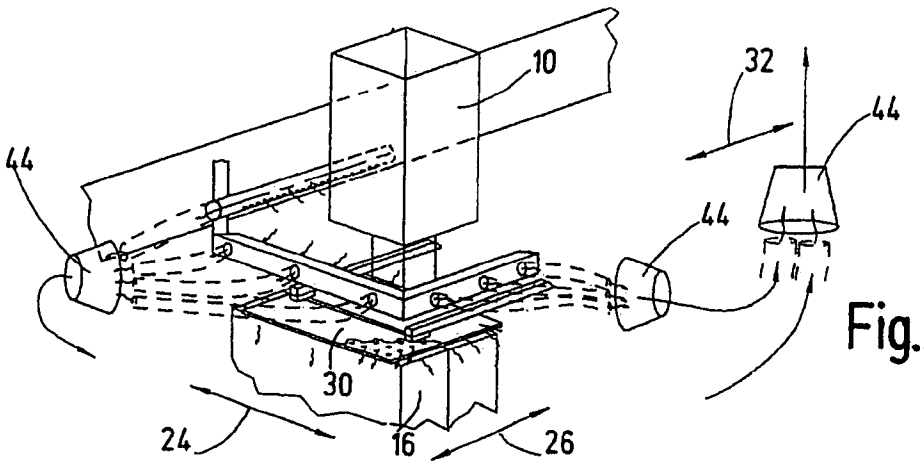

The embodiment shown in FIGS. 2*a,b,c* to a great extent resembles the first embodiment shown in FIGS. 1*a,b,c*, and will be explained only to the extent that it differs substantially from the first exemplary embodiment shown in FIG. 1. In the modified solution, the sterile barrier in the form of the cover element 30 is spatially separated from the separating element 28 and may be moved independently of the latter. By preference, the cover element 30 is associated with at least one of the mold halves and, as is illustrated in FIG. 2*b*, the two mold halves 14 are moved to be positioned under the sterile barrier. The movement of the cover element 30 may be synchronized with that of the mold halves 14. In an association of elements such as this, when the mold 16 is moved to the charging station as shown in FIG. 2*c*, the sterile barrier in the form of the cover element 30 logically is moved along with it. However, as in the case of the embodiment shown in FIGS. 2*a,b,c*, the possibility also exists of carrying out the following process sequence, specifically, one in which the mold is moved to the separating element 28 (cutter), which cuts and simultaneously moves the plate up as sterile barrier (precisely as in the illustration in FIG. 1). The mold with the plate-shaped cover element 30 then moves into the filling position. After it has arrived, the plate moves backward so that the blowing and charging mandrel may move into the opening 18. After the container has been closed along its head side, the open mold together with the plate as sterile barrier moves back to the respective initial tube position.

In the embodiment shown in FIG. 2, the separating element 28 is in addition positioned vertically at the same height, but by preference below the cover element 30.

The method claimed for the present invention is preferably applied for simultaneous production of several containers, preferably ones in the form of low-volume containers such as ampoules. The containers may be formed by blow molding or, especially in the case of very low-volume containers, also by vacuum molding.

While various embodiments have been chosen to illustrate the invention, it will be understood by those skilled in the art that various changes and modifications can be made therein without departing from the scope of the invention as defined in the appended claims.

What is claimed is:

1. A method of producing and filling containers, comprising the steps of:

extruding a tube of softened plastic material into an open mold;

closing the tube at a projecting end thereof by closing the mold to form a bottom of a container;

separating the tube above the mold by a separating element to form a filler opening;

moving the mold with the tube having the filler opening in the mold into a filling position;

after the tube is formed into the container by generating a pressure gradient acting on the tube in the mold to expand the tube, filling the container through the filler opening;

sealing the filler opening;

covering the filler opening by a sterile barrier at least from a formation time for the filler opening to filling of the tube; and conveying at least one sterile medium in a direction of the filler opening from the sterile barrier by a media delivery device.

2. A method according to claim 1 wherein the sterile medium is air, inert gas and/or hydrogen peroxide.

3. A method according to claim 1 wherein the sterile medium is conveyed at a specified over-pressure in the direction of the filler opening.

4. A method according to claim 1 wherein non-viable particles are exhausted by a suction device.

5. A method according to claim 4 wherein the suction device is a vacuum device.

6. A method according to claim 1 wherein the sterile barrier comprises a plate-shaped cover element that covers the filler opening after separation of the tube, and provides the filler opening with the sterile media until the container is filled below a sterile filling space.

7. A method according to claim 6 wherein the cover element moves together with the separating element during separation of the tube, and does not clear the filler opening until filling of the container.

8. A method according to claim 6 wherein the cover element moves synchronously with parts of the mold, and does not clear the filler opening until filling of the container.

9. A method according to claim 1 wherein the container is flushed across the filler opening by the sterile medium by the media delivery device.

10. A method according to claim 1 wherein the container is partially filled with the sterile medium by the media delivery device.

11. A method according to claim 1 wherein the sterile barrier and the sterile medium are heated to a temperature higher than 120° C.

12. A method according to claim 1 wherein the sterile barrier and the sterile medium are heated to a temperature in a range of 150° C. to 200° C.

13. A device for producing and filling containers, comprising:

at least one mold having mold parts movable between open and closed positions;

an extruder for extruding at least one tube of softened plastic material in said mold with said mold parts in said open positions;

welding edges on said mold parts for welding a projecting end of the tube to form a container bottom;

a pressure gradient generator acting on and expanding the tube in said mold;

a movable separating element for forming a filler opening by separating the tube, said separating element being movable above the mold between a retracted position and an operating position;

a filling device in a sterile filling space;

a displacement device moving said mold between an extrusion position below said extruder and a filling position below said filling device in said sterile filling space;

a sterile barrier covering the filler opening of the tube in said mold from formation thereof to filling of the tube in said sterile filling space; and a media deliverer, coupled to said sterile barrier, for conveying sterile medium in a direction of the filler opening.

14. A device according to claim 13 wherein said sterile barrier comprises a plate-shaped cover element; and said media deliverer comprises media outlet ports and at least one inlet port in said cover element.

15. A device according to claim 14 wherein said media deliverer comprises a suction frame enclosing said cover element in at least one position of said cover element.

* * * * *